US011217949B1

(12) United States Patent
Cadenhead

(10) Patent No.: US 11,217,949 B1
(45) Date of Patent: Jan. 4, 2022

(54) COAXIAL INTERFACE

(71) Applicant: RAYTHEON COMPANY, Waltham, MA (US)

(72) Inventor: David H. Cadenhead, Van Alstyne, TX (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 16/918,550

(22) Filed: Jul. 1, 2020

(51) Int. Cl.
*H01R 9/05* (2006.01)
*H01R 24/52* (2011.01)
*H01R 24/54* (2011.01)

(52) U.S. Cl.
CPC ..... *H01R 24/52* (2013.01); *H01R 9/0506* (2013.01); *H01R 9/0512* (2013.01); *H01R 24/54* (2013.01)

(58) Field of Classification Search
None
See application file for complete search history.

(56) References Cited

U.S. PATENT DOCUMENTS 2,869,090 A * 1/1959 Johanson ..... H01R 24/50 439/79
3,879,103 A * 4/1975 Peltola ..... H01R 24/50 439/581
3,910,665 A * 10/1975 Stull ..... H01R 24/50 439/63
6,971,913 B1 12/2005 Chu
7,520,774 B2 4/2009 Watanabe
8,777,637 B2 * 7/2014 Sun ..... H01R 9/0515 439/63
9,368,883 B2 * 6/2016 Chiang ..... H01R 9/0515
9,674,964 B2 6/2017 Russell
9,923,293 B2 3/2018 Swernofsky et al.
10,148,049 B2 * 12/2018 Yi ..... H01R 12/716
2014/0206221 A1 * 7/2014 Morley ..... H01R 9/05 439/370

* cited by examiner

*Primary Examiner* — Felix O Figueroa
(74) *Attorney, Agent, or Firm* — Cantor Colburn LLP

(57) ABSTRACT

A connector is provided and includes an alignment plate defining major and minor apertures, a capture plate and a pin plate. The capture plate includes an outer body defining an opening, an inner body traversing the opening and first elastic elements extending from the inner body to generate first biases. The capture plate is securable to the alignment plate to position the inner body between the major apertures. The pin plate defines intermediate apertures and includes pins and second elastic elements to generate second biases opposing the first biases. The pin plate is interposable between the alignment and capture plates whereby the intermediate and major apertures align and the pins extend through the minor apertures.

19 Claims, 7 Drawing Sheets

COAXIAL INTERFACE

BACKGROUND

The present disclosure relates to electrical connections and, in particular, to a low-cost, high-density, micro-scale coaxial interface for use in forming electrical connections.

In electronics, radio frequency (RF) connectors are often used to transmit one or more signals from one circuit board to another. RF connectors can be provided in arrays of hundreds of connectors per square inch of circuit board area. This need for small-pitch RF connector configurations is only increasing and leads to large increases in costs of RF connector assemblies or to RF connector assemblies that cannot be easily disassembled for service and repair.

SUMMARY

According to an aspect of the disclosure, a connector is provided and includes an alignment plate defining major and minor apertures, a capture plate and a pin plate. The capture plate includes an outer body defining an opening, an inner body traversing the opening and first elastic elements extending from the inner body to generate first biases. The capture plate is securable to the alignment plate to position the inner body between the major apertures. The pin plate defines intermediate apertures and includes pins and second elastic elements to generate second biases opposing the first biases. The pin plate is interposable between the alignment and capture plates whereby the intermediate and major apertures align and the pins extend through the minor apertures.

In accordance with additional or alternative embodiments, the coaxial cables are extendable through the opening, the intermediate apertures and the major apertures and the first and second elastic elements respectively apply the first biases and the second biases onto the coaxial cables and make ground connections with outer jackets of the coaxial cables that are transmitted to the pins.

In accordance with additional or alternative embodiments, the alignment plate, the capture plate and the pin plate are metallic.

In accordance with additional or alternative embodiments, the alignment plate includes wings to secure the capture plate.

In accordance with additional or alternative embodiments, the first elastic elements are configured to abut with the pin plate and to thereby provide a mechanical stop in opposition to a pressing of the capture plate toward the pin plate.

In accordance with additional or alternative embodiments, the alignment plate defines a row of the major apertures and the pin plate defines a row of the intermediate apertures.

In accordance with additional or alternative embodiments, the alignment plate defines multiple rows and columns of the major apertures and the pin plate defines multiple rows and columns of the intermediate apertures.

In accordance with additional or alternative embodiments, the major apertures have varied sizes and shapes and the intermediate apertures have at least one of varied and adjustable sizes and shapes.

According to an aspect of the disclosure, a connector assembly is provided and includes an alignment plate defining major and minor apertures, a capture plate, a pin plate, coaxial cables and a printed wiring board (PWB). The capture plate includes an outer body defining an opening, an inner body traversing the opening and first elastic elements extending from the inner body to generate first biases. The capture plate is securable to the alignment plate to position the inner body between the major apertures. The pin plate defines intermediate apertures and includes pins and second elastic elements to generate second biases opposing the first biases. The pin plate is interposable between the alignment and capture plates whereby the intermediate and major apertures align and the pins extend through the minor apertures. The coaxial cables are extendable through the opening, the intermediate apertures and the major apertures and the PWB includes first and second conductive pockets into which the pins and inner conductors of the coaxial cables are extendable, respectively.

In accordance with additional or alternative embodiments, the first and second conductive pockets are insulated from one another and include conductive polymer.

In accordance with additional or alternative embodiments, the first and second elastic elements respectively apply the first biases and the second biases onto the coaxial cables and the first and second elastic elements make ground connections with outer jackets of the coaxial cables that are transmitted to the pins and the first conductive pockets.

In accordance with additional or alternative embodiments, the alignment plate, the capture plate and the pin plate are metallic.

In accordance with additional or alternative embodiments, the alignment plate includes wings to secure the capture plate.

In accordance with additional or alternative embodiments, the first elastic elements are configured to abut with the pin plate and to thereby provide a mechanical stop in opposition to a pressing of the capture plate toward the pin plate.

In accordance with additional or alternative embodiments, the alignment plate defines a row of the major apertures and the pin plate defines a row of the intermediate apertures and the first and second conductive pockets are arranged in correspondence with an arrangement of the row of the major apertures.

In accordance with additional or alternative embodiments, the alignment plate defines multiple rows and columns of the major apertures and the pin plate defines multiple rows and columns of the intermediate apertures and the first and second conductive pockets are arranged in correspondence with an arrangement of the multiple rows and columns of the major apertures.

In accordance with additional or alternative embodiments, the major apertures have at least one of varied and adjustable sizes and shapes and the intermediate apertures have at least one of varied and adjustable sizes and shapes.

According to an aspect of the disclosure, a connector assembly is provided and includes a printed wiring board (PWB), coaxial cables and a connector. The PWB includes first and second conductive pockets and the coaxial cables respectively include an inner conductor and an outer jacket. The connector includes pins extendable into the first conductive pockets and elastic elements. The coaxial cables are extendable through the connector such that the inner conductors extend into the second conductive pockets, the connector is configured to align the pins and the inner conductors with the first and second conductive pockets, respectively, and the elastic elements are configured to elastically secure the coaxial cables and to make grounded connections from the outer jackets to the first conductive pockets via the pins.

In accordance with additional or alternative embodiments, the first and second conductive pockets are insulated from one another and include conductive polymer.

In accordance with additional or alternative embodiments, the connector includes an alignment plate defining major and minor apertures arranged in correspondence with the second and first conductive pockets, respectively, a capture plate and a pin plate. The capture plate includes an outer body defining an opening, an inner body traversing the opening and first ones of the elastic elements extending from the inner body to generate first biases. The capture plate is securable to the alignment plate to position the inner body between the major apertures. The pin plate defines intermediate apertures and includes the pins and second ones of the elastic elements to generate second biases opposing the first biases. The pin plate is interposable between the alignment and capture plates whereby the intermediate and major apertures align and the pins extend through the minor apertures.

Additional features and advantages are realized through the techniques of the present disclosure. Other embodiments and aspects detailed herein are considered a part of the claimed disclosure. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Interfaces between coaxial cables and plugs that are used to form electrical connections are typically required to make a complete coaxial connection where the outer grounding jacket of the coaxial cable makes a connection with some form of carrier which then connects to ground planes of a printed wiring board (PWB). This ground connection can often include solder processing or conductive epoxy processing into a machined carrier which can inhibit rework options. Previously, this issue has been addressed by machining or soldering micro-scaled pins onto an end of a carrier or by screen printing a conductive polymer gasket on the end of the carrier. Other solutions have involved the creation of coaxial connectors that are unable to achieve desired connector densities.

As will be described below, a low-cost, high-density and micro-scale coaxial interface is provided. The coaxial interface includes snap-together, formed photo-etched parts which mechanically contact outer jackets of micro-scale coaxial cables and to form the pins needed to pierce conductive polymer (CP) pockets on the PWB to complete ground connections. The use of formed photo-etched parts eliminates the need for precision machined pins at the carrier-to-PWB interface. Spring fingers make mechanical contact to the ground jacket at the coaxial interface and thus eliminates the need for solder processing or conductive epoxy processing. The use of snap-together features with formed photo-etched parts in the assembly allows a density of the connector to be greatly increased over the use of only one formed photo-etched part. The use of snap-together features, mechanical ground connections, and CP pockets increases an ease and ability to rework the coaxial connection.

Figure 1:
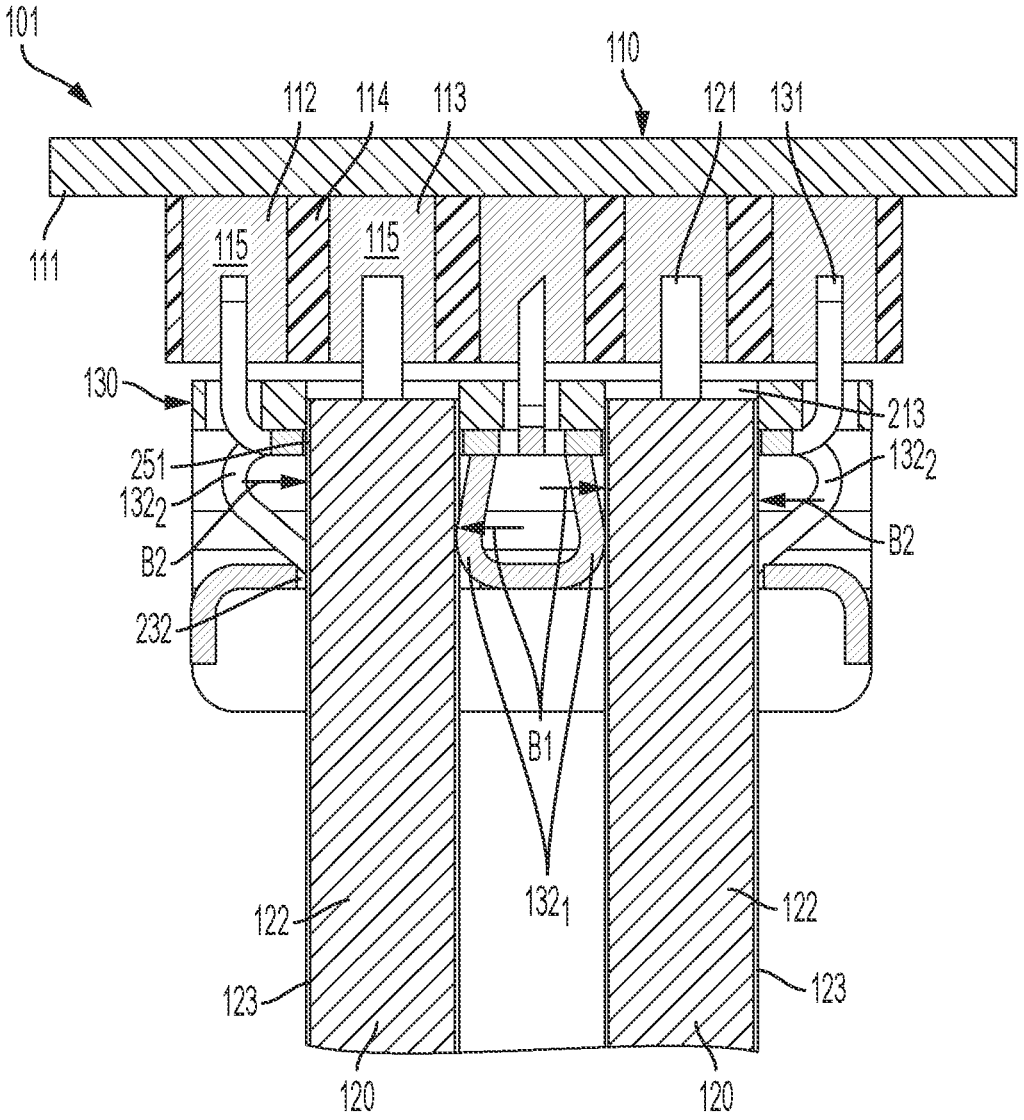
FIG. 1 is a side view of a connector assembly including a printed wiring board (PWB), coaxial cables and a connector in accordance with embodiments.

With reference to FIG. 1, a connector assembly 101 is provided and includes a PWB 110, coaxial cables 120 and a connector 130. The PWB 110 includes a PWB substrate 111, first conductive pockets 112, second conductive pockets 113 interleaved with the first conductive pockets 113 and dielectric insulators 114 interposed between adjacent ones of the first and second conductive pockets 112 and 113 to insulate the first and second conductive pockets 112 and 113 from one another. In accordance with embodiments, each of the first and second conductive pockets 112 and 113 can include conductive polymer 115 that can be engaged by pins (to be described below) for formations of grounded connections in the cases of the first conductive pockets 112 or by inner conductors (to be described below) for formations of signal connections in the cases of the second conductive pockets 113. Each of the coaxial cables 120 includes an inner conductor 121, dielectric material 122 surrounding the inner conductor and an outer jacket 123 surrounding the dielectric material 122. The connector 130 includes pins 131 that are extendable into the conductive polymer 115 of the first conductive pockets 112 to form the grounded connections, first elastic elements $\mathbf{132}_1$ and second elastic elements $\mathbf{132}_2$. The coaxial cables 120 are each extendable through the connector 120 such that the inner conductors 121 each extend into the conductive polymer 115 of the second conductive pockets 113. The connector 130 is configured to align each of the pins 131 and each of the inner conductors 121 with the first and second conductive pockets 112 and 113, respectively. The first and second elastic elements $\mathbf{132}_1$ and $\mathbf{132}_2$ are configured to elastically secure corresponding ones of the coaxial cables 120 and to make grounded connections from the outer jackets 123 to the first conductive pockets 112 via the pins 131.

In accordance with embodiments, the extensions of the pins 131 and the inner conductors 121 into the conductive polymer 115 of the first and second conductive pockets 112 and 113, respectively, forms radially compliant, axially free-running connections as disclosed in U.S. Pat. No. 9,923,293, the contents of which are incorporated herein by reference.

Figure 2:
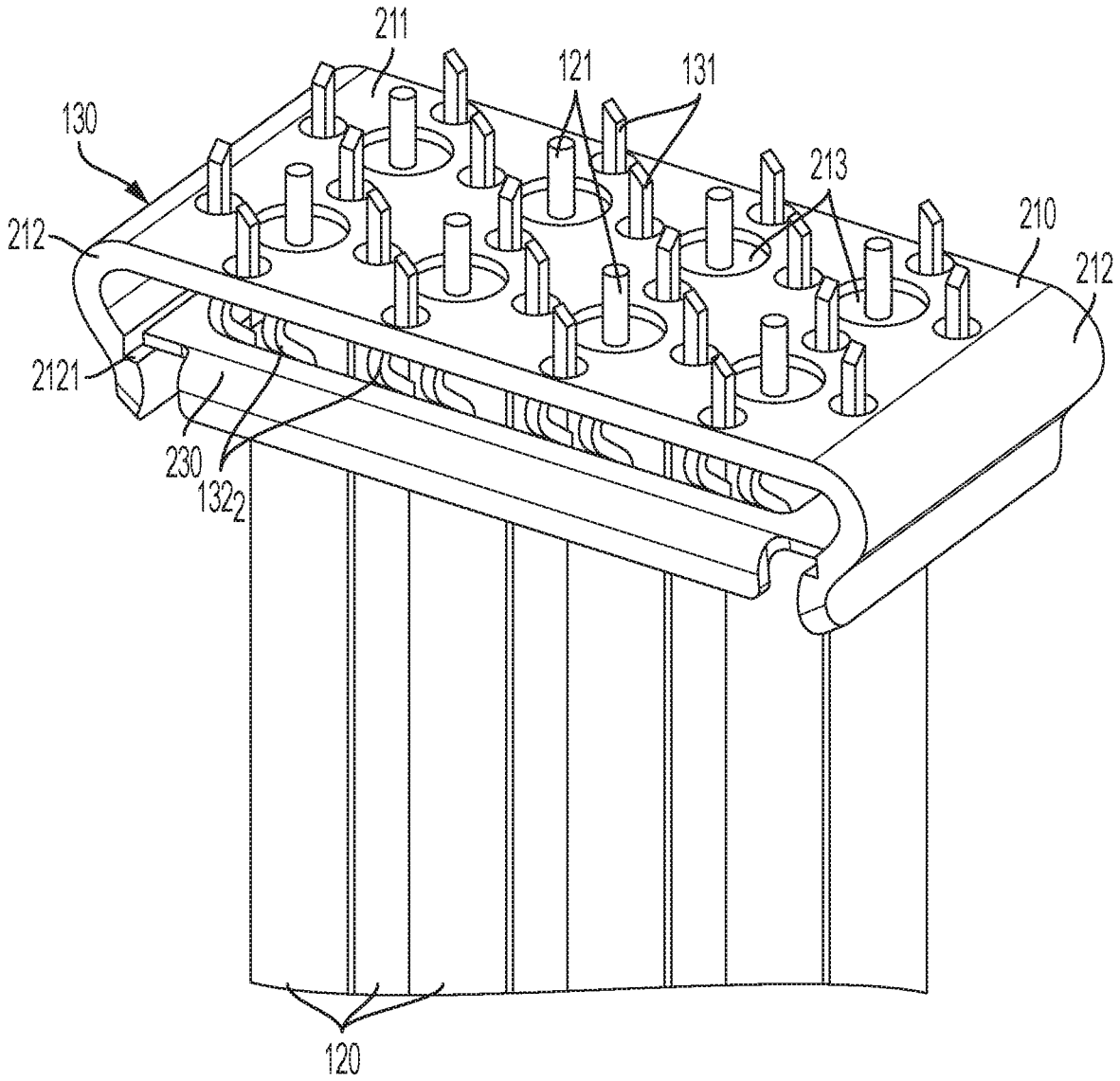
FIG. 2 is a perspective view of the coaxial cables and the connector of the connector assembly of FIG. 1.
Figure 3:
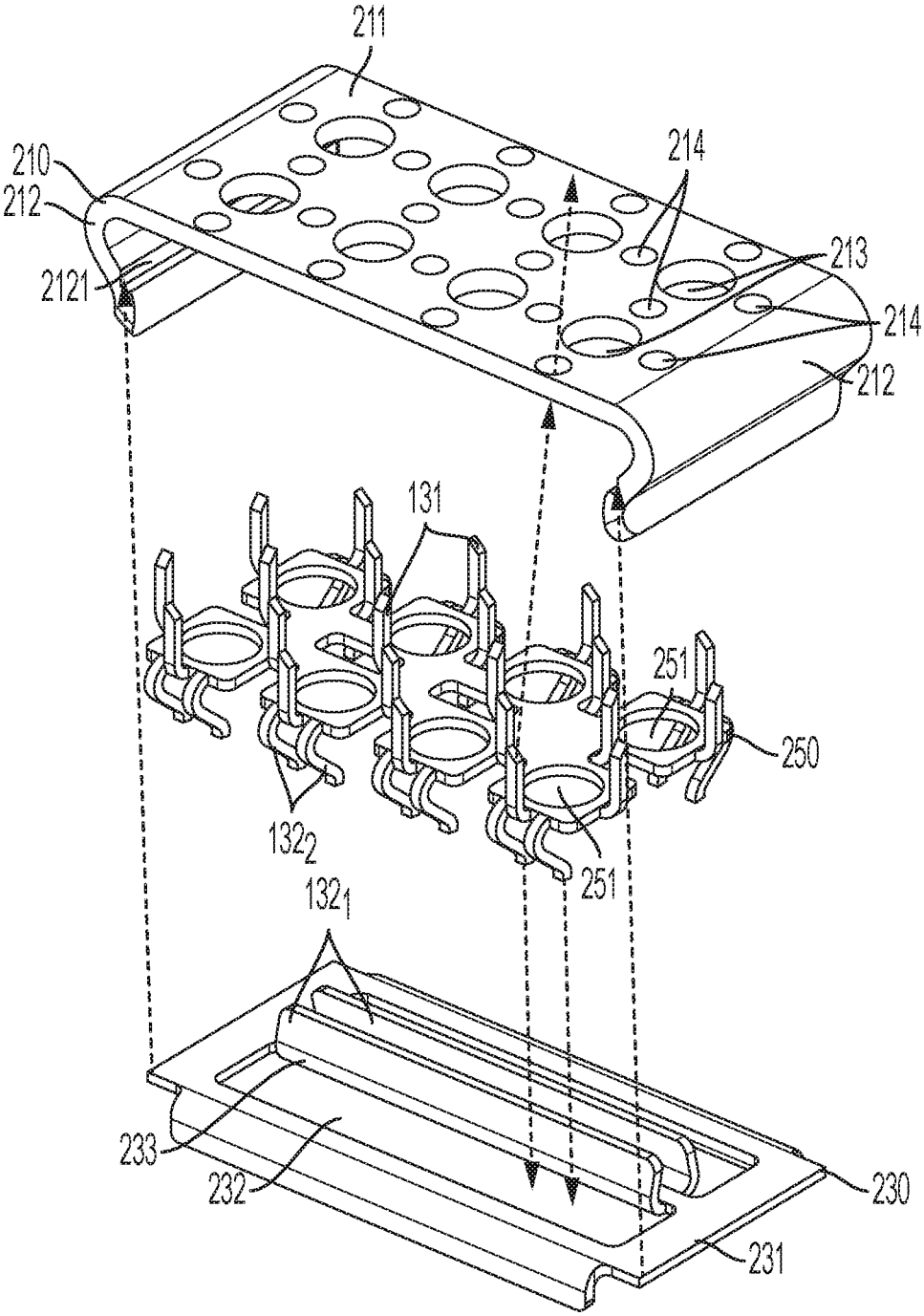
FIG. 3 is an exploded view of an alignment plate, a capture plate and a pin plate of the connector of FIGS. 1 and 2.

With continued reference to FIG. 1 and with additional reference to FIGS. 2 and 3, the connector 130 of FIG. 1 includes an alignment plate 210, a capture plate 230 and a pin plate 250. The alignment plate 210, the capture plate 230 and the pin plate 250 can be formed of a metallic material including, but not limited to, at least one of Beryllium, Copper, steel, other similar materials and combinations thereof. The alignment plate 210, the capture plate 230 and the pin plate 250 can be formed from various machining, forming, casting, pressing and etching processes or combinations thereof.

The alignment plate 210 includes a body 211 and retention wings 212 at opposite ends of the body 211. The body 211 is formed to define major apertures 213 and minor apertures 214 that may be arrayed about the major apertures 213. The retention wings 212 can be elastically deformable and define retention grooves 2121 that can engage with opposite ends of the capture plate 230. The capture plate 230 includes an outer body 231 that is formed to define an opening 232, an inner body 233 disposed to traverse the opening 232 from end-to-end and the above-mentioned first elastic elements $\mathbf{132}_1$ which extend from the inner body 233 to generate outwardly-directed or first biases B1 as shown in FIG. 1. The major apertures 213 being formed to align with and correspond with the inner body 233 and vice-versa, the inner body 233 being formed to align with and correspond with the major apertures 213. The capture plate 230 is securable to the alignment plate 210 by the opposite ends of the capture plate 230 securably engaging with the retention grooves 2121 to position the inner body 233 between the major apertures 213 of the body 211 of the alignment plate 210. The pin plate 250 is formed to define intermediate apertures 251 and includes the above-mentioned pins 131 and the above-mentioned second elastic elements $\mathbf{132}_2$ which generate inwardly-directed or second biases B2 as shown in FIG. 1 in opposition to the first biases B1. The pin plate 250 is interposable between the alignment plate 210 and the capture plate 230 whereby the intermediate apertures 251 and the major apertures 213 align with one another and whereby the pins 131 extend through the minor apertures 214 of the body 211 of the alignment plate 210.

As shown in FIGS. 1 and 2, the above-mentioned coaxial cables 120 can extend through the opening 232 on either side of the inner body 233, through the intermediate apertures 251 and through or at least into the major apertures 213 in sequence. The pins 131 and the inner conductors 121 of the coaxial cables 120 can thus be disposed for engagement with the first and second conductive pockets 112 and 113, respectively, of the PWB 110.

As shown in FIG. 1, the first elastic elements $\mathbf{132}_1$ apply the first biases B1 onto interior sides of the coaxial cables 120 in an outward direction and the second elastic elements $\mathbf{132}_2$ apply the second biases B2 onto exterior sides of the coaxial cables 120 in an inward direction in opposition to the first biases B1. This oppositional biasing serves to frictionally secure the coaxial cables 120 in their respective positions. Also, the first elastic elements $\mathbf{132}_1$ and the second elastic elements $\mathbf{132}_2$ make ground connections with the outer jackets 123 of the coaxial cables 120. These ground connections are then transmitted to the pins 131 and the first conductive pockets 112. In addition, the first elastic elements $\mathbf{132}_1$ are configured to abut with the pin plate 250 and to thereby provide a mechanical stop in opposition to a pressing of the capture plate 230 toward the pin plate 250.

In accordance with embodiments, the alignment plate 210 is formed to define a row of the major apertures 213 (with the minor apertures 214 symmetrically arrayed about the major apertures 213) and the pin plate 250 is formed to define a row of the intermediate apertures 251. In these or other cases, the first and second conductive pockets 112 and 113 of the PWB 110 are arranged in positional correspondence with an arrangement of the row of the major apertures 213. In accordance with further embodiments, the alignment plate 210 is formed to define multiple rows and multiple columns of the major apertures 213 (with the minor apertures 214 symmetrically arrayed about the major apertures 213) and the pin plate 250 is formed to define multiple rows and multiple columns of the intermediate apertures 251. In these or other cases, the first and second conductive pockets 112 and 113 of the PWB 110 are arranged in positional correspondence with an arrangement of the multiple rows and the multiple columns of the major apertures 213.

Figure 4:
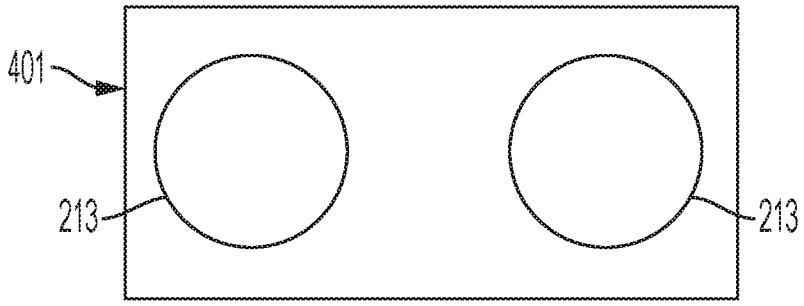
FIG. 4 is a schematic plan view of an arrangement of apertures of the alignment plate of FIG. 3 in accordance with embodiments.
Figure 5:
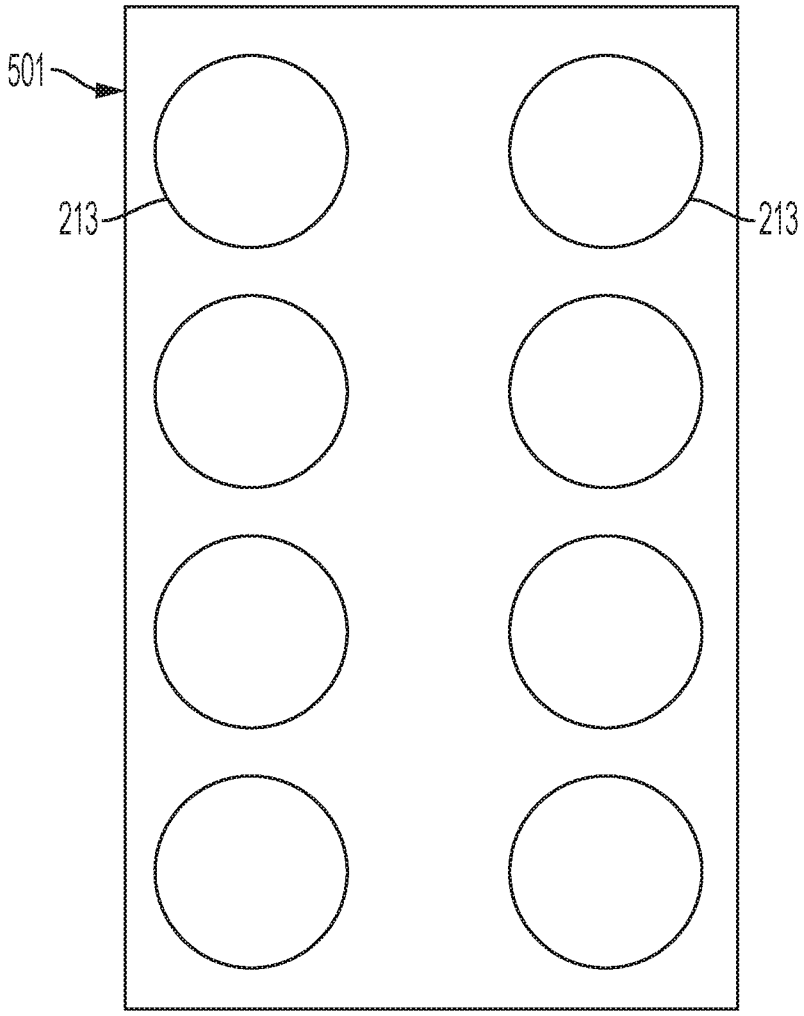
FIG. 5 is a schematic plan view of an arrangement of apertures of the alignment plate of FIG. 3 in accordance with embodiments.
Figure 6:
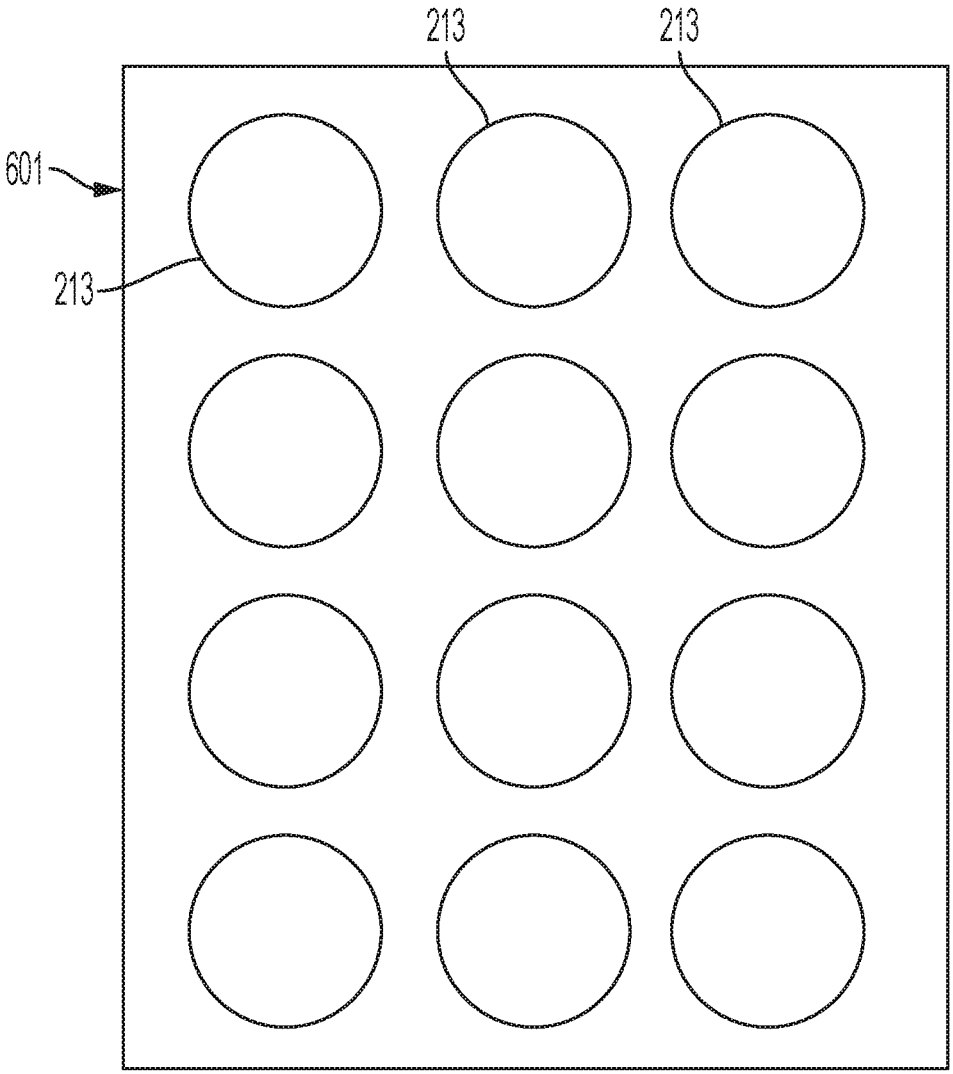
FIG. 6 is a schematic plan view of an arrangement of apertures of the alignment plate of FIG. 3 in accordance with embodiments.
Figure 7:
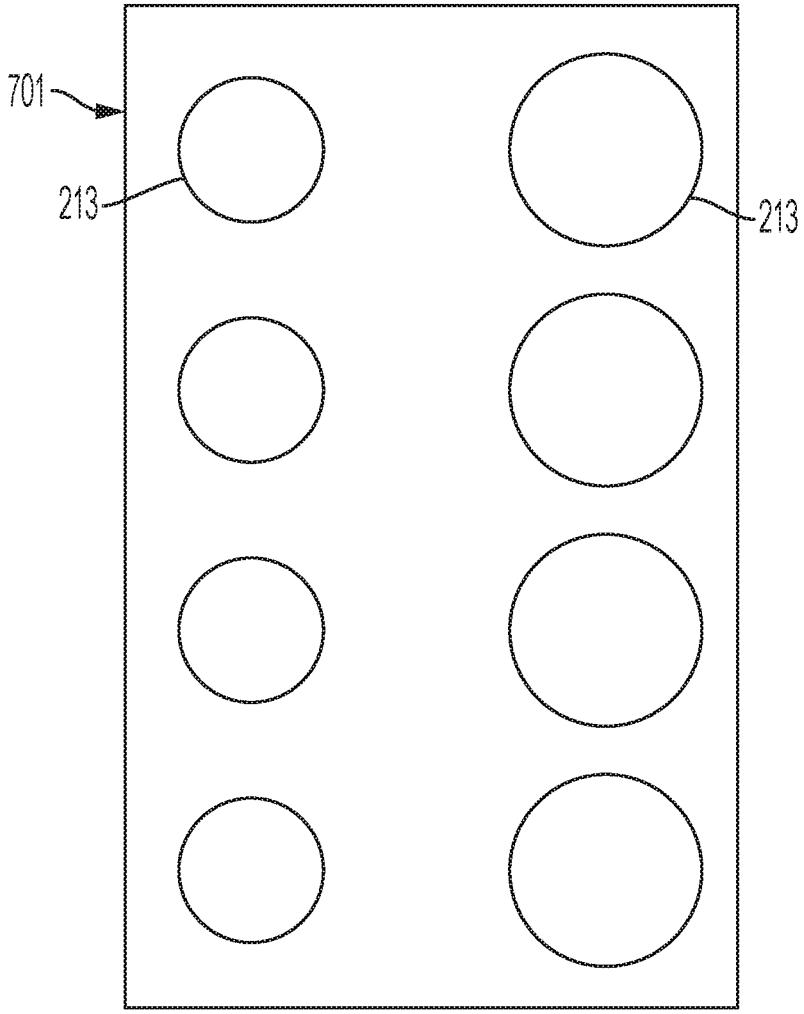
FIG. 7 is a schematic plan view of an arrangement of apertures of varying sizes of the alignment plate of FIG. 3 in accordance with embodiments.
Figure 8:
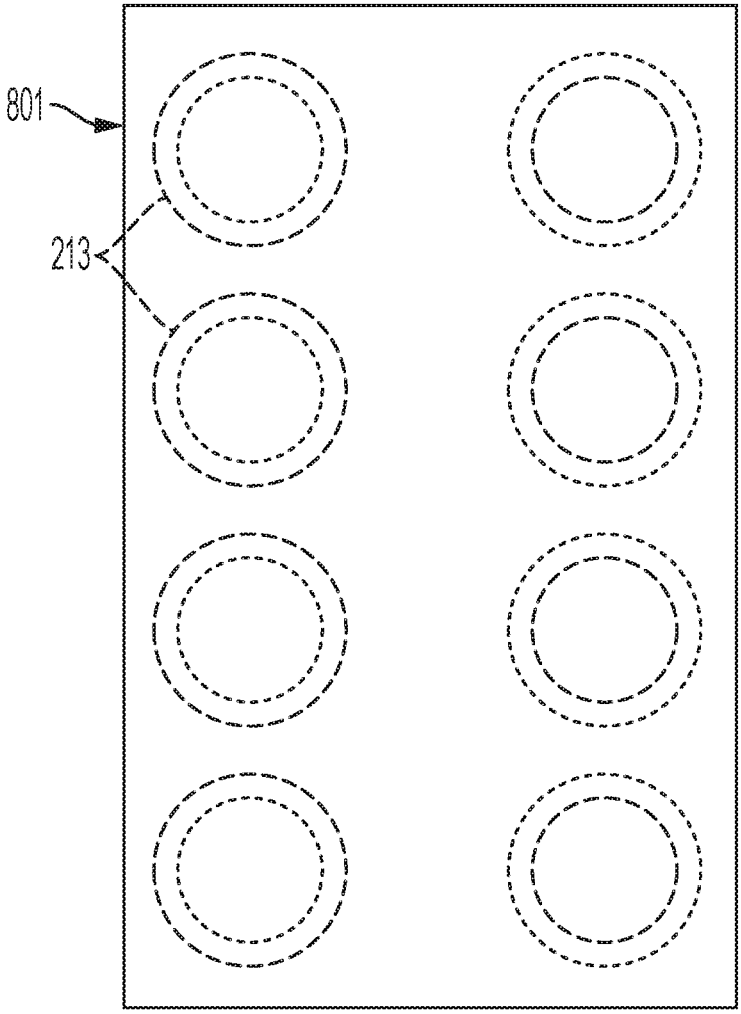
FIG. 8 is a schematic plan view of an arrangement of apertures of adjustable sizes of the alignment plate of FIG. 3 in accordance with embodiments.

With reference to FIGS. 4-8, various embodiments of the row-column arrangements and relative sizes of the various apertures and the conductive pockets 112 and 113 described above are provided in terms of the major apertures 213 with the understanding that the other features will be arranged accordingly. As shown in FIGS. 4-6, an arrangement 401 of a single row of major apertures 213 is provided (see FIG. 4), an arrangement 501 of multiple rows and two columns of major apertures 213 is provided (see FIG. 5) and an arrangement 601 of multiple rows and multiple columns of major apertures 213 is provided (see FIG. 6). As shown in FIGS. 7 and 8, an arrangement 701 is provided in which each of the major apertures 213 can have varied relative sizes (see FIG. 7) and an arrangement 801 is provided in which each of the major apertures 213 can have adjustable relative sizes (see FIG. 8).

Technical effects and benefits of the present disclosure are the provision of low-cost, re-workable, re-useable, micro-scale, high-density, snap-together coaxial connections that eliminate the need for precisely machined pins, compliant conductive gaskets, as well as the need for solder or epoxy processing.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the technical features in the form as disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

While the preferred embodiments to the disclosure have been described, it will be understood that those skilled in the art, both now and in the future, may make various improvements and enhancements which fall within the scope of the claims which follow. These claims should be construed to maintain the proper protection for the disclosure first described.

What is claimed is:

1. A connector, comprising:

an alignment plate defining major and minor apertures;

a capture plate comprising an outer body defining an opening, an inner body traversing the opening and first elastic elements extending from the inner body to generate first biases, the capture plate being securable to the alignment plate to position the inner body between the major apertures; and a pin plate defining intermediate apertures and comprising pins and second elastic elements to generate second biases opposing the first biases, the pin plate being interposable between the alignment and capture plates whereby the intermediate and major apertures align and the pins extend through the minor apertures.

2. The connector according to claim 1, wherein:

coaxial cables are extendable through the opening, the intermediate apertures and the major apertures, the first and second elastic elements respectively apply the first biases and the second biases onto the coaxial cables and make ground connections with outer jackets of the coaxial cables that are transmitted to the pins.

3. The connector according to claim 1, wherein the alignment plate, the capture plate and the pin plate are metallic.

4. The connector according to claim 1, wherein the alignment plate comprises wings to secure the capture plate.

5. The connector according to claim 1, wherein the first elastic elements are configured to abut with the pin plate and to thereby provide a mechanical stop in opposition to a pressing of the capture plate toward the pin plate.

6. The connector according to claim 1, wherein the alignment plate defines a row of the major apertures and the pin plate defines a row of the intermediate apertures.

7. The connector according to claim 1, wherein the alignment plate defines multiple rows and columns of the major apertures and the pin plate defines multiple rows and columns of the intermediate apertures.

8. The connector according to claim 1, wherein the major apertures have varied sizes and shapes and the intermediate apertures have at least one of varied and adjustable sizes and shapes.

9. A connector assembly, comprising:

an alignment plate defining major and minor apertures;

a capture plate comprising an outer body defining an opening, an inner body traversing the opening and first elastic elements extending from the inner body to generate first biases, the capture plate being securable to the alignment plate to position the inner body between the major apertures;

a pin plate defining intermediate apertures and comprising pins and second elastic elements to generate second biases opposing the first biases, the pin plate being interposable between the alignment and capture plates whereby the intermediate and major apertures align and the pins extend through the minor apertures;

coaxial cables extendable through the opening, the intermediate apertures and the major apertures; and a printed wiring board (PWB) comprising first and second conductive pockets into which the pins and inner conductors of the coaxial cables are extendable, respectively.

10. The connector assembly according to claim 9, wherein the first and second conductive pockets are insulated from one another and comprise conductive polymer.

11. The connector assembly according to claim 9, wherein:

the first and second elastic elements respectively apply the first biases and the second biases onto the coaxial cables, and the first and second elastic elements make ground connections with outer jackets of the coaxial cables that are transmitted to the pins and the first conductive pockets.

12. The connector assembly according to claim 9, wherein the alignment plate, the capture plate and the pin plate are metallic.

13. The connector assembly according to claim 9, wherein the alignment plate comprises wings to secure the capture plate.

14. The connector assembly according to claim 9, wherein the first elastic elements are configured to abut with the pin plate and to thereby provide a mechanical stop in opposition to a pressing of the capture plate toward the pin plate.

15. The connector assembly according to claim 9, wherein:

the alignment plate defines a row of the major apertures and the pin plate defines a row of the intermediate apertures, and the first and second conductive pockets are arranged in correspondence with an arrangement of the row of the major apertures.

16. The connector assembly according to claim 9, wherein:

the alignment plate defines multiple rows and columns of the major apertures and the pin plate defines multiple rows and columns of the intermediate apertures, and the first and second conductive pockets are arranged in correspondence with an arrangement of the multiple rows and columns of the major apertures.

17. The connector assembly according to claim 9, wherein the major apertures have at least one of varied and adjustable sizes and shapes and the intermediate apertures have at least one of varied and adjustable sizes and shapes.

18. A connector assembly, comprising:

a printed wiring board (PWB) comprising first and second conductive pockets;

coaxial cables respectively comprising an inner conductor and an outer jacket;

a connector comprising pins extendable into the first conductive pockets and elastic elements, the coaxial cables being extendable through the connector such that the inner conductors extend into the second conductive pockets, the connector being configured to align the pins and the inner conductors with the first and second conductive pockets, respectively, and the elastic elements being configured to elastically secure the coaxial cables and to make grounded connections from the outer jackets to the first conductive pockets via the pins, wherein the connector comprises:

an alignment plate defining major and minor apertures arranged in correspondence with the second and first conductive pockets, respectively;

a capture plate comprising an outer body defining an opening, an inner body traversing the opening and first ones of the elastic elements extending from the inner body to generate first biases, the capture plate being securable to the alignment plate to position the inner body between the major apertures; and a pin plate defining intermediate apertures and comprising the pins and second ones of the elastic elements to generate second biases opposing the first biases, the pin plate being interposable between the alignment and capture plates whereby the intermediate and major apertures align and the pins extend through the minor apertures.

19. The connector assembly according to claim 18, wherein the first and second conductive pockets are insulated from one another and comprise conductive polymer.

* * * * *